United States Patent [19]

Sikora

[11] Patent Number: 4,701,672

[45] Date of Patent: Oct. 20, 1987

[54] STROBE FLASH MONITOR

[75] Inventor: Scott T. Sikora, Mesa, Ariz.

[73] Assignee: Tomar Electronics, Inc., Tempe, Ariz.

[21] Appl. No.: 737,797

[22] Filed: May 28, 1985

[51] Int. Cl.[4] ..... H05B 41/32

[52] U.S. Cl. ..... 315/241 S; 315/241 P; 315/307; 315/308; 315/129

[58] Field of Search ..... 315/241 P, 241 S, 129, 315/307, 308, 224, 225, 299; 340/641, 643, 657

[56] References Cited

U.S. PATENT DOCUMENTS

| | | | |
|---|---|---|---|
| 2,286,030 | 6/1942 | Young et al. | 315/241 S |
| 3,274,486 | 9/1966 | Gould et al. | 315/241 S |
| 4,005,337 | 1/1977 | Rabe | 315/241 S |
| 4,354,142 | 10/1982 | Seitz | 315/241 S |
| 4,438,370 | 3/1984 | Allington | 315/308 |
| 4,511,195 | 4/1985 | Barter | 315/308 |

*Primary Examiner*—Leo H. Boudreau
*Assistant Examiner*—Michael Razavi
*Attorney, Agent, or Firm*—Cahill, Sutton & Thomas

[57] ABSTRACT

The operation of a strobe lighting system is electronically monitored from a remote location to verify proper operation of all of the individual elements of the system. A current sensor is coupled in series with the flow of current between the strobe power supply and the strobe lamp and generates a voltage pulse in response to each flash inducing pulse of current through the strobe lamp. A remote indicator is coupled to the current sensor and generates a humanly perceptible output signal (visual or audible) in response to the voltage pulse from the current sensor. The strobe flash monitor enables a strobe lighting system user to continuously monitor system operation without direct observation of the strobe lamp flashes.

17 Claims, 6 Drawing Figures

STROBE FLASH MONITOR

BACKGROUND OF THE INVENTION

1. Field of the Invention

This invention relates to strobe lighting systems and more particularly, to strobe lighting systems having means for remotely monitoring system operation without directly observing strobe lamp flashes.

2. Description of the Prior Art

Strobe lighting systems typically comprise a strobe power supply, a strobe lamp assembly which includes a strobe lamp and a trigger transformer, and a power cable which interconnects the strobe lamp and power supply. For the following reasons, it is desirable to periodically reverify strobe lamp flashing:

1. Strobe lamp flashing verifies strobe power supply operation;
2. Strobe lamps periodically burn out or break and must be replaced;
3. Strobe lamps may be stolen or removed without authorization; and
4. The strobe power supply to strobe lamp interconnecting cable or plugs may develop unpredictable open or short circuit conditions.

In many installations, the strobe power supply is physically separated from the strobe lamp. In such installations an operator controls or initiates system operation by actuating switches located on the power supply or on a control head which is also physically spaced apart from the strobe light. In many installations, the strobe lighting system operator cannot verify proper system operation without physically moving to a location where he can directly observe and verify that each strobe lamp in the system is flashing with the proper intensity, at the desired rate and in the appropriate sequence. Since strobe lighting systems are frequently used in safety-related applications, periodic verification of proper system operation is important and continuous monitoring of system operation is highly desirable.

For the reasons stated above, there exists a significant need for an inexpensive system for continuously monitoring the flashes of one or more strobe lamps in a strobe lighting system.

SUMMARY OF THE INVENTION

It is therefore a major object of the present invention to provide a strobe flash monitor capable of monitoring and verifying illumination of one or more strobe lamps from a location where direct observation of the strobe lamp is inconvenient or impossible.

Another major object of the present invention is to provide a strobe flash monitor which can easily be incorporated in newly manufactured strobe lighting systems or which can readily be retrofit in existing strobe lighting systems.

Another object of the present invention is to provide a strobe flash monitor which is simple, reliable and compact.

Another object of the present invention is to provide a strobe flash monitor which can be coupled to a strobe power supply, to a strobe lamp assembly or to the interconnecting cable which joins those two system elements to permit convenient installation of the monitor in either a new or an existing installation.

Yet another object of the present invention is to provide a strobe flash monitor which provides either a visual or an audible indication of strobe lamp illumination.

Still another object of the present invention is to provide a strobe flash monitor capable of interfacing with an electronic monitoring device such as a computer for automatically and continuously monitoring the operation of one or more strobe lighting systems.

Briefly stated, and in accord with one embodiment of the invention, a strobe flash monitor electronically monitors the operation of a strobe lamp from a remote location. The strobe lighting system includes a strobe power supply for periodically flashing a strobe lamp which is coupled in series with the power supply output leads. A current sensor is coupled in series with the strobe lamp to generate an output voltage in response to a current pulse through the strobe lamp. Remote indicator means is coupled to the current sensor and generates a humanly perceptible output signal in response to the output voltage from the current sensor to enable a strobe system user to continuously monitor the operation of the strobe lamp without direct visual observation of the strobe lamp flash.

DESCRIPTION OF THE DRAWINGS

The invention is pointed out with particularity in the appended claims. However, other objects and advantages together with the operation of the invention may be better understood by reference to the following detailed description taken in connection with the following illustrations, wherein:

DESCRIPTION OF THE PREFERRED EMBODIMENT

In order to better illustrate the advantages of the invention and its contributions to the art, a preferred hardware embodiment of the invention will now be described in some detail.

Figure 1:
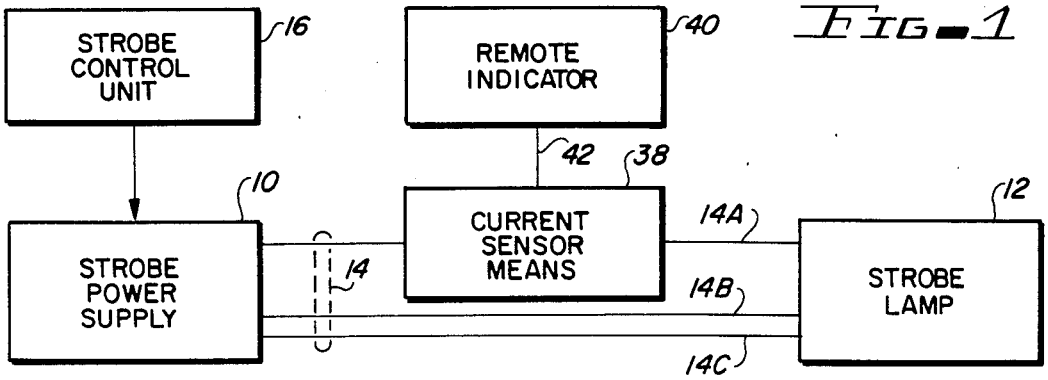
FIG. 1 is a block diagram illustration of a strobe lighting system incorporating the strobe flash monitor of the present invention.

FIG. 1 represents a generalized block diagram of a strobe flash monitor incorporated in a typical strobe lighting system including a strobe power supply 10, a strobe lamp assembly 12 and a power supply to strobe lamp interconnect cable 14. A strobe control unit 16 may either be colocated with strobe power supply 10 or positioned in a spaced apart location. The strobe control unit 16 turns strobe power supply 10 on or off or selects a particular mode of operation for the strobe lamp system. In many installations, a strobe lighting system will include a plurality of strobe lamps 12 operating in a variety of different modes.

In a police car having a strobe flash bar installation, strobe power supply 10 is typically placed in a secure, weather tight location such as a vehicle trunk and the strobe flash bar is secured to the vehicle roof, while the strobe control unit 16 is located in the vehicle interior. In other installations, the strobe control unit 16 may be placed within the enclosure for the strobe power supply 10. In a large number of installations, strobe lamp assembly 12 is positioned where it cannot be directly viewed by a person operating the strobe control unit 16.

Figure 2:
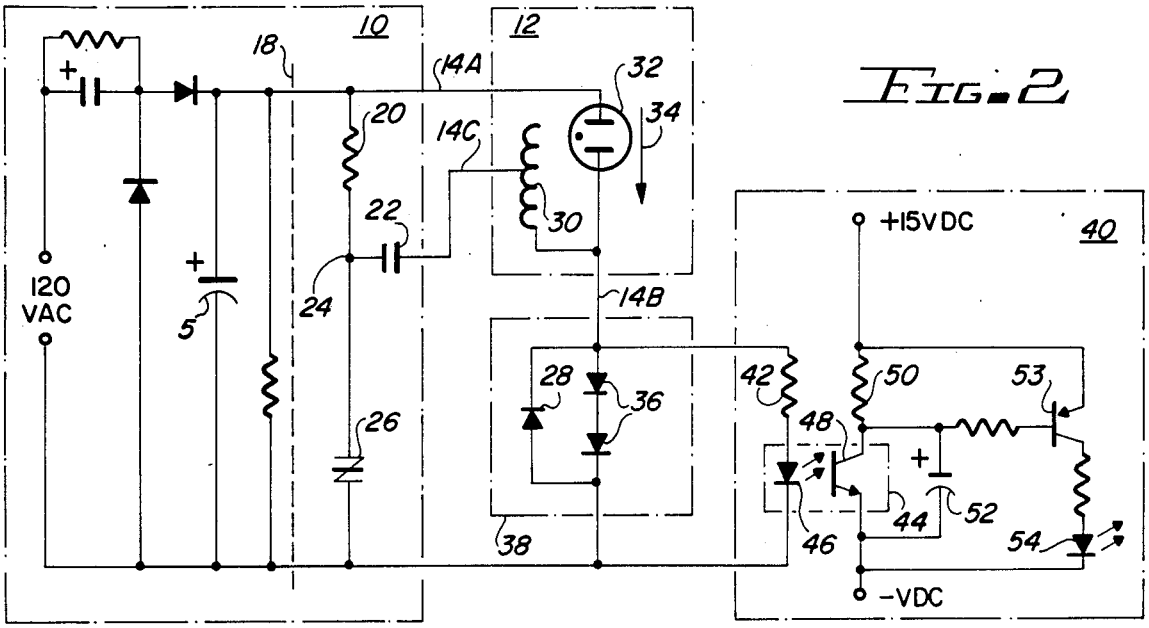
FIG. 2 is an electrical schematic diagram illustrating a preferred embodiment of the various elements of the present invention. The specific circuitry of strobe power supply 10 has been provided solely for the purpose of illustration and is not intended to restrict the scope of the invention.
Figure 3A:
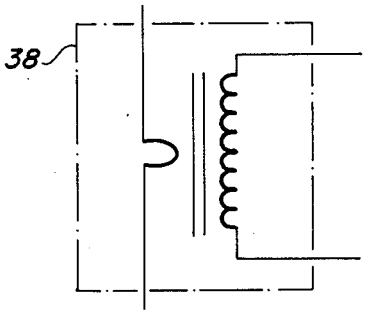
FIGS. 3A–D depict various alternative electronic components capable of functioning as the current sensor means of the present invention.
Figure 3B:
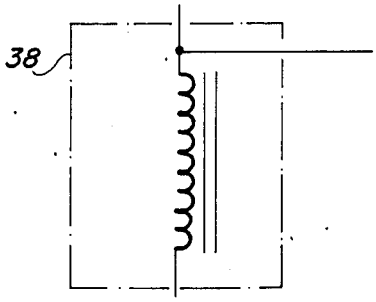
Figure 3C:
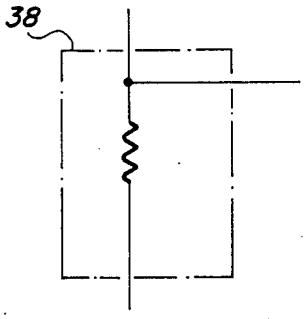
Figure 3D:
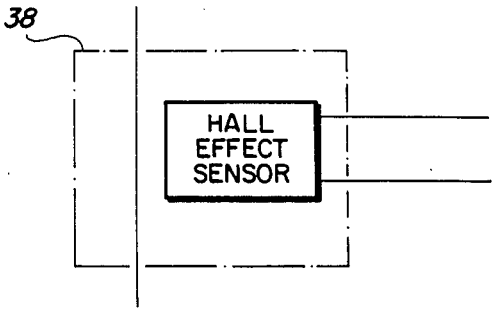

FIG. 2 illustrates a strobe power supply 10 and a strobe lamp assembly 12 of conventional design. The diodes, capacitors and resistors located to the left of dotted line 18 operate as a voltage doubler circuit which converts one hundred and twenty volts AC into three hundred and forty to three hundred and sixty volts DC to energize the strobe lamp. The DC output from the voltage doubler flows through resistor 20 (3.3 megohms) and charges a capacitor 22. When the voltage at node 24 reaches approximately one hundred and twenty volts DC, sidac 26 trips, assumes a negative resistance, and discharges capacitor 22 through diode 28 and the primary winding of a trigger transformer 30. The firing of trigger transformer 30 ionizes the xenon gas within strobe lamp 32 creating a comparatively low impedence path between the strobe lamp cathode and anode which causes the charge stored in energy storage capacitor 5 to be discharged through strobe lamp 32 in the direction indicated by arrow 34 and results in a strobe lamp flash. In a typical strobe power supply of the type illustrated in FIG. 2, the high level strobe lamp flash current creates about a three volt pulse across series connected diodes 36. After approximately fifty microseconds, most of the energy stored in the power supply will have been dissipated through strobe lamp 32, the current flowing through the strobe lamp will decrease below the minimum holding current of the strobe lamp, and the current flow through diodes 36 decreases to zero.

In FIGS. 1 and 2, the group of diodes 28 and 36 have been designated as current sensor means 38 which functions to generate an output voltage in response to the strobe lamp flash current flowing through power supply leads 14A and 14B.

A remote indicator unit 40 is coupled by a voltage conductor 42 to receive the strobe flash induced voltage generated by current sensor means 38. In the preferred embodiment of the invention, remote indicator 40 includes an optoisolator 44 in which a light emitting diode 46 turns on a transistor 48 in response to each voltage pulse generated by current sensor means 38. A resistor 50 (4.7k) and a capacitor 52 (1 microFarad) are coupled as shown to function as a pulse stretcher to substantially extend the fifty microsecond duration of the voltage pulse caused by strobe lamp ignition. Current flow through transistor 48 turns on transistor 53 and illuminates a humanly perceptible indicator in the form of a light emitting diode 54. The pulse extender circuitry produces a longer, brighter illumination of light emitting diode 54 and facilitates remote operator monitoring of flashes from strobe lamp 32.

Current sensor means 38 may be positioned in any desired location. For example, current sensor means 38 may form a part of either strobe power supply 10 or strobe lamp assembly 12. Alternatively, current sensor means 38 may be coupled in series with power supply lead 14A as illustrated in FIG. 1 or in series with power supply lead 14B as illustrated in FIG. 2.

A number of different types of electronic components may be used to function as current sensor means 38. FIG. 3 indicates that the primary of a current transformer (FIG. 3A), an inductor (FIG. 3B), a resistor (FIG. 3C) or a Hall effect sensor (FIG. 3D) may be substituted for diodes 28 and 36 as depicted in FIG. 2. Each of the different electronic elements described above function as an acceptable current sensor when coupled in series with power supply leads 14A and 14B and generates an output voltage in response to current pulses through a strobe lamp as is required to practice the present invention.

In prior art strobe power supplies, a group of three diodes have been connected in series with a strobe lamp as illustrated in FIG. 2 to generate a voltage pulse in response to each strobe lamp flash. In these prior art units, the voltage output from this diode assembly provides a feedback signal to a power supply deactivation circuit which removes the source of input power from the strobe power supply during each strobe flash. This feedback controlled power supply deactivation circuit prevents a high capacity power supply from maintaining a continuous, high voltage input to the strobe lamp which would maintain the strobe lamp in a continuously ionized state. This feedback controlled power supply deactivation circuit ensures short, controlled duration strobe lamp flash pulses and prevents continuous duty strobe operation. In the present invention, diodes 28 and 36 function as current sensor means for actuating a humanly perceptible remote indicator unit 40. The current sensor means 38 of the present invention is not used in a feedback controlled power supply deactivation system as was the case with the prior art unit described above. The specific remote indicator means 40 depicted in FIG. 2 has been included to illustrate only one embodiment of that element of the invention. Numerous other different circuit configurations are capable of converting a short duration voltage pulse into a humanly perceptible signal for permitting a strobe lighting system operator to continuously and in real time monitor the operation of a remotely located strobe lamp. Such circuitry is well known to persons of ordinary skill in the art.

In many strobe lighting system applications, a single strobe power supply operates several different strobe lamps. In such multi-strobe lighting systems, one current sensor means 38 is coupled between strobe power supply 10 and each strobe lamp 32 to generate voltage pulses corresponding with the flashing of each strobe lamp. A separate remote indicator 40 is provided for each strobe lamp 32 to enable an operator to monitor a corresponding LED 54 to verify on a real time basis the proper operation of each different strobe lamp. Each LED may be labelled to designate the specific strobe lamp monitored by that LED. Alternatively, red, green or other color LED's may be used in the remote indicator 40 to indicate correspondence with strobe lamp assemblies which include red, green or other color lenses. Remote indicator 40 may also be coupled to a computerized monitoring system for continuously and automatically monitoring strobe system operation. Numerous other modifications and variations of the strobe flash monitor invention described above would be readily apparent to one of ordinary skill in the art. Accordingly, it is intended by the appended claims to cover all such modifications of the invention which fall within the true spirit and scope of the invention.

I claim:

1. Apparatus for electronically monitoring the emission of optical flashes by a strobe lamp from a remote location spaced apart from said strobe lamp comprising:

a. a strobe power supply for causing a strobe lamp to emit an optical flash by periodically discharging an energy storage capacitor through said strobe lamp to direct a capacitor discharge current pulse through said strobe lamp;

b. current sensor means coupled in series with the flow of the capacitor discharge current pulse through said strobe lamp for generating an output voltage corresponding to the flow of the capacitor discharge current pulse through said strobe lamp and to the emission of an optical flash by said strobe lamp; and c. remote indicator means spaced apart from said strobe lamp and coupled to said current sensor means for generating a humanly perceptible output signal in response to the output voltage from said current sensor means to enable a strobe system user to continuously monitor the emission of optical flashes by said strobe lamp without visually observing said strobe lamp.

2. The strobe lamp monitoring apparatus of claim 1 wherein said strobe lamp is positioned in a first location and said strobe power supply is positioned in a second location spaced apart from said first location.

3. The strobe lamp monitoring apparatus of claim 1 wherein said remote indicator means is positioned in a third location spaced apart from said first and second locations;

4. The strobe lamp monitoring apparatus of claim 3 wherein said current sensor means is positioned at a fourth location spaced apart from said first, second and third locations.

5. The strobe lamp monitoring apparatus of claim 3 wherein said current sensor means is colocated with said strobe power supply.

6. The strobe lamp monitoring apparatus of claim 3 wherein said current sensor means is colocated with said strobe lamp.

7. The strobe lamp monitoring apparatus of claim 3 wherein said current sensor means includes diode means for generating a voltage pulse in response to the flow of current from said power supply through said strobe lamp.

8. The strobe lamp monitoring apparatus of claim 7 wherein said current sensor means includes means for sensing each voltage pulse and generating a corresponding humanly perceptible output signal.

9. The strobe lamp monitoring apparatus of claim 8 wherein said voltage sensing means includes:

a. an optoisolator for generating an output current in response to each voltage pulse; and b. flash indicator means for converting the output current into the humanly perceptible output signal.

10. The strobe lamp monitoring apparatus of claim 9 wherein said flash indicator means includes a light emitting diode for generating a light pulse in response to each strobe flash.

11. The strobe lamp monitoring apparatus of claim 10 wherein said flash indicator means includes means for extending the pulse width of the light pulse emitted by said light emitting diode.

12. The strobe lamp monitoring apparatus of claim 7 wherein said diode means includes first and second diodes coupled in series.

13. The strobe lamp monitoring apparatus of claim 12 wherein said diode means includes a third diode coupled with reverse polarity in parallel with said first and second diodes for passing strobe trigger current to said strobe lamp.

14. The strobe lamp monitoring apparatus of claim 3 wherein said current sensor means includes a resistor.

15. The strobe lamp monitoring apparatus of claim 3 wherein said current sensor means includes an inductor.

16. The strobe lamp monitoring apparatus of claim 3 wherein said current sensor means includes a current transformer having a primary winding coupled in series with said strobe lamp.

17. The strobe lamp monitoring apparatus of claim 3 wherein said current sensor means includes a Hall effect sensor for generating an output voltage in response to a magnetic field induced by the flow of current through said strobe lamp.

* * * * *